US007577394B2

(12) United States Patent
Sekiya

(10) Patent No.: US 7,577,394 B2
(45) Date of Patent: Aug. 18, 2009

(54) SHEET CONVEYING APPARATUS AND IMAGE FORMING APPARATUS

(75) Inventor: Harukazu Sekiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 429 days.

(21) Appl. No.: 11/265,099

(22) Filed: Nov. 3, 2005

(65) Prior Publication Data

US 2006/0103068 A1 May 18, 2006

(30) Foreign Application Priority Data

Nov. 5, 2004 (JP) ..... 2004-321788

(51) Int. Cl.
*G03G 15/00* (2006.01)

(52) U.S. Cl. ..... 399/405; 271/264

(58) Field of Classification Search ..... 399/124, 399/405; 271/264, 273, 274
See application file for complete search history.

(56) References Cited

U.S. PATENT DOCUMENTS

2005/0135855 A1* 6/2005 Park et al. ..... 399/405
2005/0254872 A1* 11/2005 Nonaka et al. ..... 399/401
2005/0281598 A1* 12/2005 Hattori et al. ..... 399/405
2006/0103068 A1 5/2006 Sekiya ..... 271/264

FOREIGN PATENT DOCUMENTS

JP 10-194517 7/1998
JP 2001-278524 10/2001

* cited by examiner

*Primary Examiner*—David M Gray
*Assistant Examiner*—Andrew V Do
(74) *Attorney, Agent, or Firm*—Fitzpatrick, Cella, Harper & Scinto

(57) ABSTRACT

An apparatus of the present invention includes a first guide supported by a cover body in such a manner that the first guide can swing around a hinge with respect to the main body of the apparatus and a second guide provided on the apparatus main body. The first guide is supported in such a manner that it can move with respect to the cover body. When the cover body swings so as to open a sheet conveyance path, a site of the first guide on the side of the hinge swings with respect to the cover body in such a direction so as to separate from the second guide.

8 Claims, 6 Drawing Sheets

SHEET CONVEYING APPARATUS AND IMAGE FORMING APPARATUS

CROSS-REFERENCE TO RELATED APPLICATION

This application claims the benefit of priority from the prior Japanese Patent Application No. 2004-321788 filed on Nov. 5, 2004 the entire contents of which are incorporated by reference herein.

BACKGROUND OF THE INVENTION

1. Field of the Invention

The present invention relates to a sheet conveying apparatus for conveying a sheet and an image forming apparatus equipped with the same.

2. Description of the Related Art

Such a conventional sheet conveying apparatus is known as to includes a movable first conveyance guide and a fixed second conveyance guide to a main body of the apparatus with a sheet conveyance path provided therebetween in such a configuration that the first conveyance guide turns around a fixed swing fulcrum with respect to a main body of the apparatus.

Such a sheet conveying apparatus is disclosed in Japanese Patent Application Laid-open No. 10-194517 as a prior art. Such a re-feed unit is known as to temporarily stack thereon a sheet on which an image is formed by image forming means and then convey it again. The re-feed unit includes a conveyance guide for conveying a sheet after a sheet is formed on it and an intermediate tray for placing the sheet thereon temporarily. The conveyance guide is composed of an upper conveyance guide and a lower conveyance guide between which a sheet conveyance path is formed, serving also as a cover for the intermediate tray in configuration.

In this configuration, the upper conveyance guide and the lower conveyance guide are coupled to each other by an arm. Therefore, when an end of the upper conveyance guide is gripped and raised, this upper conveyance guide is separated from the lower conveyance guide by a predetermined distance. In turn, the lower conveyance guide coupled to the upper conveyance guide by the arm is separated from the intermediate tray in condition where it is interlocked with the upper one. Then, by swinging the upper conveyance guide, an interior of the conveyance guide and a space above the intermediate tray can be opened so that a jam clearance operation can be performed.

However, according to this conventional example, an opening angle of the conveyance guide is not more than 90 degrees, so that a vicinity of the swing fulcrum has a smaller space than a free end (which is to be gripped) of the conveyance guide; therefore, if a sheet is jammed near the swing fulcrum, the jammed sheet cannot easily cleared.

SUMMARY OF THE INVENTION

It is an object of the present invention to make it easy to perform a jam clearance operation near a swing fulcrum even if a swing angle of a conveyance guide is small.

To achieve the above object, there is provided a sheet conveying apparatus of the present invention including a movable body which can swing around a swing fulcrum with respect to a main body of the apparatus, a first conveyance guide that is movably supported to the movable body and guides a sheet and a second conveyance guide which is provided on the main body of the apparatus, to guide the sheet, wherein the movable body can swing between a first position where the first conveyance guide and the second conveyance guide are combined to form a sheet conveyance path to convey the sheet and a second position where the first conveyance guide is distanced from the second conveyance guide to enlarge a space for the sheet conveyance path, and when the movable body swings from the first position to the second position, a site of the first conveyance guide on the side of the swing fulcrum of the movable body moves in such a direction as to be separated from the second conveyance guide with respect to the movable body.

There is provided another sheet conveying apparatus of the present invention including a movable body that can swing around a swing fulcrum with respect to a main body of the apparatus, a first conveyance guide which forms a sheet conveyance path to convey a sheet, and which is supported movably by the movable body, and a second conveyance guide which forms the sheet conveyance path, and which is provided on the main body of the apparatus, wherein when the movable body swings with respect to the main body of the apparatus in such a direction as to open the sheet conveyance path, a site of the first conveyance guide on the side of the swing fulcrum moves in such a direction as to be separated from the second conveyance guide with respect to the movable body.

DESCRIPTION OF THE PREFERRED EMBODIMENTS

The following will describe in detail exemplified preferred embodiments of the present invention with reference to drawings. However, a size, a material, a shape, and a relative layout thereof which are components described in the following embodiments are to be changed appropriately according to a configuration and a variety of conditions of an apparatus to which the present invention is applied. Therefore a scope of the present invention is not intended to be limited to them unless otherwise specified.

First Embodiment

Figure 1:
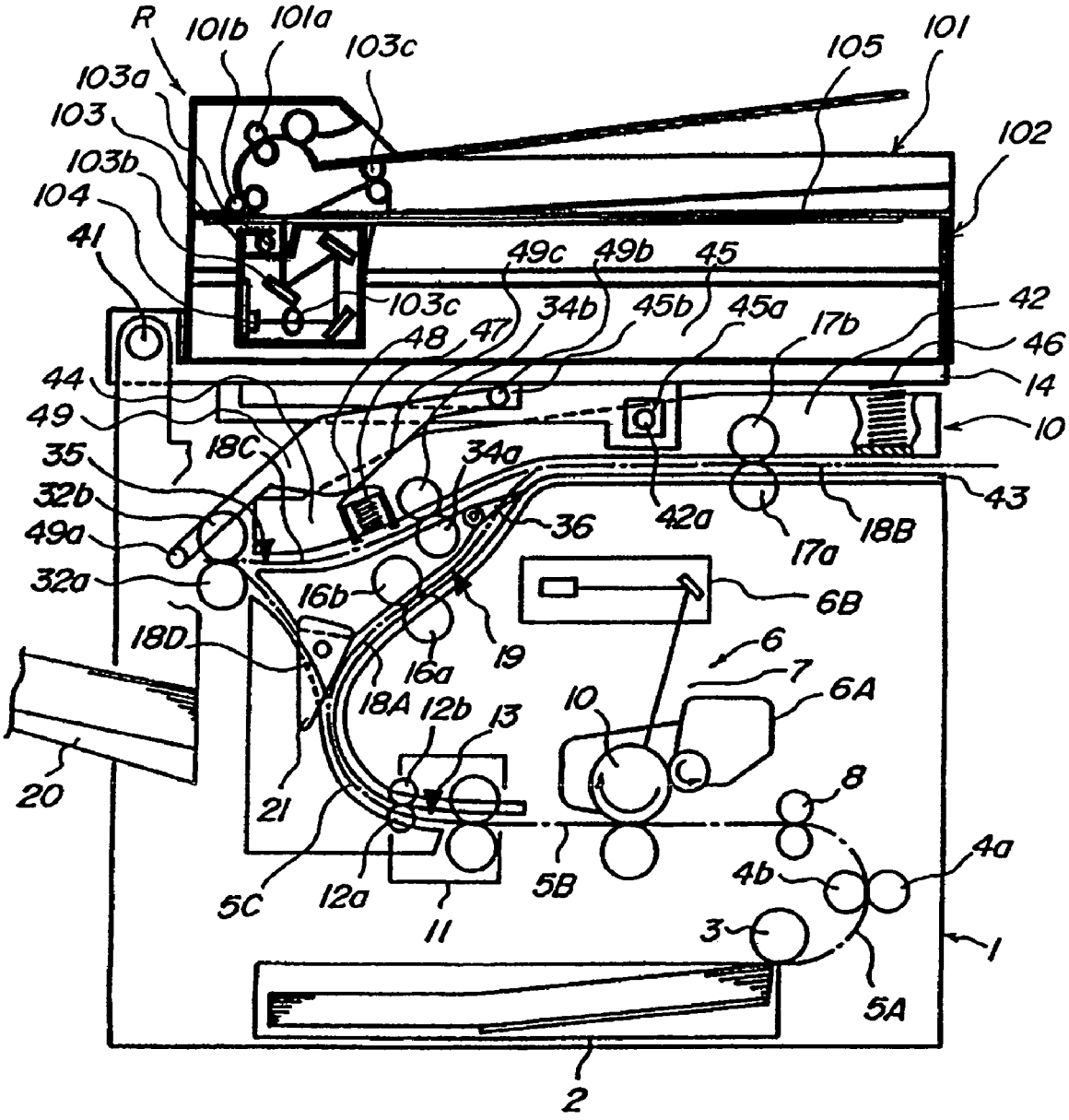
FIG. 1 is a cross-sectional view of a condition where an image forming apparatus equipped with a sheet conveying apparatus according to a first embodiment can operate.
Figure 2:
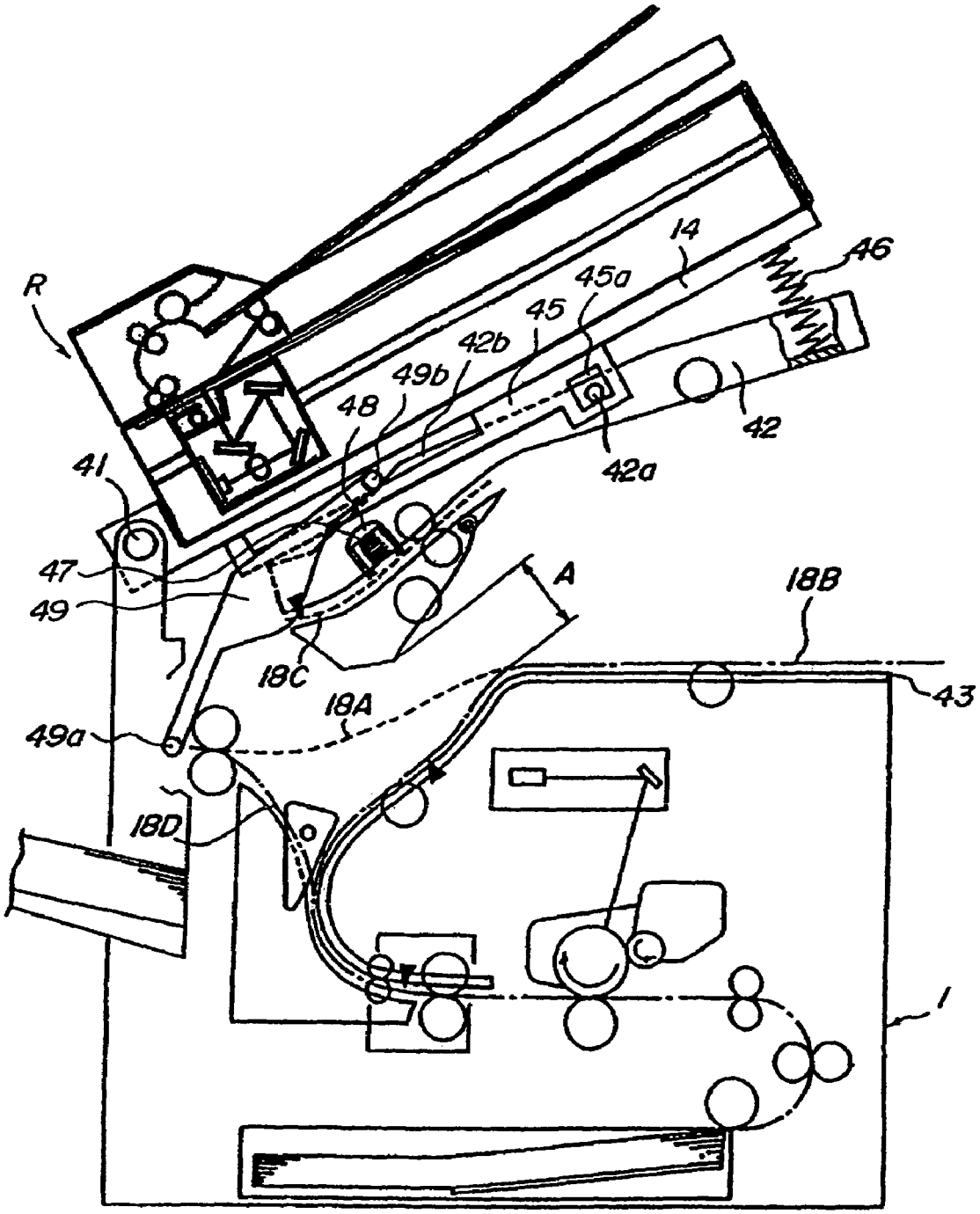
FIG. 2 is a cross-sectional view of a condition where a conveyance path of the image forming apparatus equipped with the sheet conveying apparatus according to the first embodiment is broken up so that a jammed sheet can be cleared.

The following will describe an image forming apparatus equipped with a sheet conveying apparatus according to the first embodiment with reference to FIGS. 1 and 2. FIGS. 1 and 2 are simplified configuration diagrams of the image forming apparatus according to the first embodiment of the present invention.

<Simplified Configuration of Image Forming Apparatus>

In FIG. 1, a reference number 1 indicates a main body of a printer which is the image forming apparatus. Below the printer main body 1, a sheet cassette 2, which is sheet storage means to stack and store a plurality of sheets, is arranged on the front side of the apparatus with respect to the printer main body.

Above the sheet cassette 2, image forming means 6 is arranged. The image forming means 6 includes an image forming process unit 6A that has a photosensitive drum 10 serving as an image bearing member, to transfer onto a sheet a toner image on the photosensitive drum 10 and a laser scanner 6B for emitting laser light that is arranged above the image forming process unit 6A, to form an electrostatic latent image based on an image signal on the photosensitive drum.

Further, on the downstream side in a sheet conveying direction with respect to the image forming process unit 6A, a fixing device 11, which applies heat and pressure to a sheet on which a toner image is transferred by the image forming process unit 6A to thereby fix the toner image onto the sheet, is arranged. On the downstream side in the sheet conveying direction with respect to the fixing device 11, a fixing/discharge driving rollers 12*a* and fixing/discharge driven rollers 12*b* are arranged. Further, between the fixing device 11 and the fixing/discharge rollers 12*a* and fixing/discharge driven rollers 12*b*, a fixing/discharge sensor 13 is provided.

On the downstream side in the sheet conveying direction with respect to the fixing device 11, a pair of discharge rollers 32*a* and 32*b*, which are sheet discharge means discharging a sheet on which an image is fixed by the fixing device 11 from a side of the printer main body 1, are arranged. On the side of the printer main body 1 and below the discharge rollers 32*a* and 32*b*, a discharge tray 20 for receiving sheets discharged from the discharge roller pair 32*a* and 32*b* is arranged in such a manner that its sheet stacking surface may be inclined with respect to the side of the printer main body down.

Between the sheet cassette 2 and the image forming process unit 6A, a first sheet conveyance path 5A, which turns back in an inverted C shape above the sheet cassette 2 and goes toward a position below the image forming process unit 6A, is formed.

Along the sheet conveyance path 5A, a feed roller 3 for feeding a sheet stacked on the sheet cassette 2 from the sheet cassette 2 and a registration roller 8 for conveying a sheet fed from separation/conveyance roller pair 4*a* and 4*b* toward the image forming process unit 6A, are arranged.

Between the image forming process unit 6A and the fixing device 11, a second sheet conveyance path 5B is formed.

Between the fixing device 11 and the discharge roller pair 32*a* and 32*b*, a third sheet conveyance path 5C, which goes up from the downstream side in the sheet conveying direction with respect to the fixing device 11 toward the discharge pair 32*a* and 32*b*, is formed.

Above the image forming process unit 6A and the laser scanner 6B, sheet turn-back means 15, which turns back a sheet on whose upper surface a toner image is fixed by the fixing device 11 and conveys it to the discharge roller pair 32*a* and 32*b*, is arranged. That is, the sheet turn-back means 15 is arranged at an upper portion of the printer main body 1 opposite to the sheet cassette 2 through the image forming means 6.

The sheet turn-back means 15 includes a turn-back conveyance path 18A which branches off from the third sheet conveyance path 5C provided on the downstream side of the fixing device 11, a turn-back staying path 18B which continues to the turn-back conveyance path 18A and is provided on an upper surface of the printer main body 1, and a turn-back discharge path 18C which branches off from a point where the turn-back conveyance path 18A and the turn-back staying path 18B are connected and goes toward the discharge roller pair 32*a* and 32*b*.

At an entrance of the turn-back conveyance path 18A, a first flapper 21 is provided. By switching the first flapper 21, it is possible in configuration to select whether a sheet conveyed from the fixing device 11 is directly conveyed to the discharge roller pair 32*a* and 32*b* or is conveyed to the turn-back conveyance path 18A. Further, on the downstream side of the turn-back conveyance path 18A with respect to the first flapper 21, a convergence roller 16*a* and a convergence roller 16*b* are arranged. Above the convergence rollers 16*a* and 16*b*, a turn-back discharge path sheet detection sensor 19 is arranged.

At an entrance of the turn-back staying path 18B, a turn-back roller 17*a* and a turn-back roller 17*b* are arranged. These turn-back rollers 17*a* and 17*b* are configured so that they can be normally and reversely rotated by driving means such as a motor (not shown) when they are normally rotated, a sheet is conveyed to the turn-back staying path 18B, and when they are reversely rotated, the sheet is conveyed to the turn-back discharge path 18C.

At an entrance of the turn-back discharge path 18C, a second flapper 36 is provided. The second flapper 36 is configured so that tip of the second flapper 36 may normally be applied a force to by a force applied by a spring or the like so as to block up an exit of the turn-back conveyance path 18A. By setting the force applied by the spring or the like to the second flapper 36 to an appropriate weak level, the second flapper 36 is configured to be raised by a front end of a sheet conveyed toward the turn-back staying path 18B so that the sheet may be allowed to go through to the side of the turn-back staying path 18B. Alternatively, the second flapper 36 may be configured so that switchover is made using a solenoid or the like between these conveyance paths at a predetermined timing the sheet passes through.

Between the second flapper 36 and the discharge roller pair 32*a* and 32*b*, a conveyance roller 34*a* and a conveyance roller 34*b* are provided. Further, between the conveyance rollers 34*a* and 34*b* and the discharge roller pair 34*a* and 32*b*, a turn-back discharge path sheet detection sensor 35 is provided.

The turn-back discharge path 18C and the third sheet conveyance path 5C are configured to join immediately in front of the discharge roller pair 32*a* and 32*b*.

The discharge roller pair 32*a* and 32*b* are arranged on the side of the upper portion of the printer main body 1 and more inside the printer main body 1 than the side of a lower portion where the sheet cassette 2 of the printer main body 1 is arranged.

In FIG. 1, the printer main body 1 is equipped with a cover body 14 as a rotary movable body on its upper surface. The cover body 14 is attached with a hinge 41 to the printer main body 1 in such a manner that it can be opened and closed.

Above the image forming apparatus, an image reader R is provided which reads an image of an original. The image reader R is attached to an upper portion of the cover 14. The image reader R swings together with the cover body 14 with respect to the printer main body 1.

The image reader R is composed of an original conveying apparatus 101 for conveying an original and a reader body 102.

The reader body 102 is provided with an original base plate glass 105 on which an original is placed and a reading unit 103 for reading an image of the original. The reading unit 103 is held on the reader body 102 in such a manner that it can move horizontally shown in FIG. 1. The reading unit 103 has a light source 103*a*, a mirror 103*b*, a lens 103*c*, and a photoelectric transducer 104.

The original conveying apparatus 101 includes a conveying roller triad 101*a*, 101*b* and 101*c* for conveying the original. The original conveying apparatus 101 is supported by the reader body 102 in such a manner that it can swing, thereby permitting the upper surface of the original base plate glass 105 to be exposed.

Below the laser scanner 6B, a container unit 7 for the image forming process unit 6A is formed. The image forming process unit 6A is contained in the container 7 detachably.

In a condition where the process unit 6A is contained in the container unit 7, the laser scanner 6B is appropriately located at a position where the photosensitive drum 10 can be exposed to laser light emitted from the laser scanner 6B and fixed to the printer main body 1.

When the cover body 14 (and the image reader R) are opened, the container unit 7 is opened, so that the process unit 6A can be attached and detached without moving the laser scanner 6B.

<Operations of Image Forming Apparatus>

The following will describe operations of the image forming apparatus related to the present embodiment.

First, operations of the image reader R are described.

To read an image of an original conveyed by the original conveying apparatus 101, the image of the original can be read by the reading unit 103 at a position of FIG. 1. Light emitted from the light source 103*a* is reflected by a surface of the original and the mirror 103*b* in this order, passes through the lens 103*c*, and falls on the photoelectric transducer 104.

To read an image of an original stacked on the original base plate glass 105, the reading unit 103 can read the image of the original as moving. Light reflected by a surface of the original stacked on the original base plate glass 105 is reflected by the mirror 103*b*, passes through the lens 103*c*, and falls on the photoelectric transducer 104.

The light thus made incident upon the photoelectric transducer is performed in photoelectric conversion by the photoelectric transducer. In such a manner, the image reader R obtains image information of the original.

Next, operations of the printer unit 1 are described. It is to be noted that image forming operations such as forming of an electrostatic latent image and fixing of a toner image and the like are already known and so their is not described. Operations of conveying a sheet by the sheet conveying apparatus in the printer main body 1 are described in detail.

Face-up Discharge

When a toner image is transferred onto a sheet by the image forming means 6 and fixed on the side of an upper surface of the sheet by the fixing device 11, the sheet is conveyed by the fixing/discharge rollers 12*a* and fixing/discharge driven rollers 12*b* to the third sheet conveyance path 5C and discharged via a face-up conveyance path 18D by the discharge roller pair 32*a* and 32*b* onto the discharge tray 20 in a condition where the image-formed surface of the sheet faces upward. This is face-up discharge. In the case where the sheets are discharged in the face-up manner, since the image-formed surfaces face upward, a merit that a copy condition can be recognized quickly is provided.

Face-down Discharge

For example, in a case where a plurality of originals is read by the original conveying apparatus 101 to consecutively form images based on information of this plurality of images, the sheets discharged onto the discharge tray 20 in a face-down discharge manner, that is, in a condition where image-formed surfaces of the sheets face downward, can be accommodated line-up of the sheet pages. Such face-down discharge operations are described below.

When a toner image is transferred onto a sheet by the image forming means 6 and fixed on an upper surface of the sheet by the fixing device 11, the sheet is conveyed by the fixing/discharge rollers 12*a* and fixing/discharge driven rollers 12*b* to the third sheet conveyance path 5C. In this case, the first flapper 21 is switched over in a direction shown in FIG. 1, thereby causing the sheet to be conveyed from the fixing device 11 to the turn-back conveyance path 18A. The sheet thus conveyed onto the turn-back conveyance path 18A passes through the convergence rollers 16*a* and 16*b*, raises an front end of the second flapper 36, and is further conveyed by the turn-back rollers 17*a* and 17*b* to the turn-back staying path 18B.

At a predetermined timing at which a back-end of the sheet conveyed to the turn-back staying path 18B passes through the second flapper 36, the turn-back rollers 17*a* and 17*b* are reversed in rotation.

The timing at which the turn-back rollers 17*a* and 17*b* are reversed in rotation can be obtained by detecting the front end or back-end of the sheet by using the turn-back discharge path sheet detection sensor 19 provided on the turn-back conveyance path 15 and, based on the detected value, calculating the predetermined timing at which the back-end of the sheet passes through the second flapper 36.

Since the turn-back rollers 17*a* and 17*b* are reversed in rotation, the sheet stayed on the turn-back staying path 18B is conveyed to the turn-back discharge path 18C. In this case, as described above, the front end of the second flapper 36 is applied a force downward to by the spring or the like, so that the sheet is prevented from being conveyed backward to the turn-back conveyance path 18A and permitted to travel to the turn-back discharge path 18C.

Then, the sheet is conveyed by the conveyance rollers 34*a* and 34*b* and the discharge rollers 32*a* and 32*b* and discharged onto the discharge tray 20 in a condition where an image-formed surface of the sheet faces downward. This is face-down discharge.

<Details of Sheet Conveying Apparatus>

The following will describe in detail the sheet conveying apparatus in the image forming apparatus. FIG. 1 shows a condition where the cover body, which is the movable body, is located at a first position. FIG. 2 shows a condition where the cover body 14 is located at a second position.

A first guide 42 that forms an upper portion of the sheet conveyance path constituted of the turn-back staying path 18B and the turn-back discharge path 18C and thus guides a sheet has the turn-back roller 17*b* and the conveyance roller 34*b*.

The first guide 42 further has a first spring 46 and a second spring 47. The first spring 46 serving as force application means is provided between the cover body 14 and the first guide 42, to apply force in such a manner as to separate the cover body 14 and the first guide 42 from each other. The second spring 47 is provided with a pressure application member 48 that can move in a direction in which a pressure is applied by the second spring 47 to thereby attach the second spring 47 to the first guide 42 in such a manner that a force can be applied to the second spring 47.

A seat of the spring of the pressure application member 48 and its opposite face provide a cam face made of a sliding member.

A second guide 43 serving as a second conveyance guide that forms the lower portion of the sheet conveyance path constituted of the turn-back conveyance path 18A and the turn-back staying path 18B has the turn-back roller 17*a* and the convergence roller 16*a* and is fixed to the printer main body 1.

A third guide 44 that forms the upper portion of the turn-back conveyance path 18A, the lower portion of the turn-back conveyance path 18C, and the upper portion of the face-up conveyance path 18D has the convergence roller 16*b*, the conveyance roller 34*a*, and the second flapper 36 and is engaged with the first guide 42 by an arm (not shown) in such a manner that it can swing.

The first guide 42 is supported by the cover body 14 movably by inserting a support shaft 42*a* provided on the first guide 42 into a hole 45*a* in a guide member 45 provided on the cover body 14. When the cover body 14 is opened as shown in FIG. 2, the first guide 42 serving as the first conveyance guide and the third guide 44 move together with the cover body 14, to open the turn-back conveyance path 18A, the turn-back staying path 18B, and the face-up discharge path 18D.

A link guide member 49 is provided between the printer main body 1 and the cover body 14. One end 49*a* of the link guide member 49 is attached in such a manner that it can swing around a swing fulcrum provided on the printer main body 1 and the other end 49*b* is engaged in such a manner that it can move along a guide hole 45*b* formed in the guide member 45.

When the printer main body 1 is operable as shown in FIG. 1, the cover body 14 presses the first spring 46 to apply a force to the first guide 42 toward the second guide 43. A cam face 49*c* of the link guide member 49, on the other hand, presses the cam face of the force application member 48, which is a part of the first guide 42. Accordingly, the first guide 42, the second guide 43, and the third guide 44 abut against each other at their abutments (not shown) to form the turn-back conveyance path 18A, the turn-back staying path 18B, and the turn-back discharge path 18C that compose the sheet conveyance path, thereby permitting a sheet of paper to pass therethrough.

Next, a condition where the cover body 14 is swung is described with reference to FIG. 2.

When a lock member (not shown) is released, the cover body 14 swings around the hinge 41 counterclockwise with respect to the printer main body 1 and held by a support member such as a damper (not shown) in a condition where it is swung.

When the cover body 14 swings from the first position shown in FIG. 1 to the second position shown in FIG. 2, the link guide member 49 also swings around the one end 49*a* supported by the printer main body 1.

Since the other end 49*b* of the link guide member 49 moves along the guide hole 45*b* in the guide member 45, the cam face 49*c* of the link guide member 49 leaves the cam face of the pressure application member 48 attached to the first guide 42, so that the link guide 49 stops applying a pressure to the second spring 47 attached to the first guide 42. That is, force application due to the pressure application member 48 in a direction of the second guide 43 from the first guide 42 is released.

Further, since the first spring 46 applies a force between the cover body 14 and the first guide 42, the first guide 42 turns around the support shaft 42*a* until a corner 42*b* of the first guide 42 comes in contact with the cover body 14.

By thus swinging the first guide 42 and the third guide 44 attached to the first guide 42 with respect to the cover body 14, a site of the first guide 42 on the side of the hinge 41 is additionally separated from the second guide 43. Therefore, even if the cover body 14 swings at a small angle with respect to the printer main body 1, it is possible to enlarge the smallest distance A between the group of guides 42 and 44 moving together with the cover body 14 and the second guide 43 remaining in the printer main body 1 (space between the group of guides 42 and 44 and the second guide 43 remaining in the printer main body 1) in the vicinity of the hinge 41 serving as the swing fulcrum. It is thus possible to easily clear a sheet left on the turn-back conveyance path 18A. In such a case as the present embodiment in which the cover body 14 cannot easily be swung at a large angle because the cover body 14 is provided with the image reader R, such a configuration is especially effective that the site of the first guide 42 on the side of the hinge 41 may additionally be separated from the second guide 43.

Second Embodiment

Figure 3:
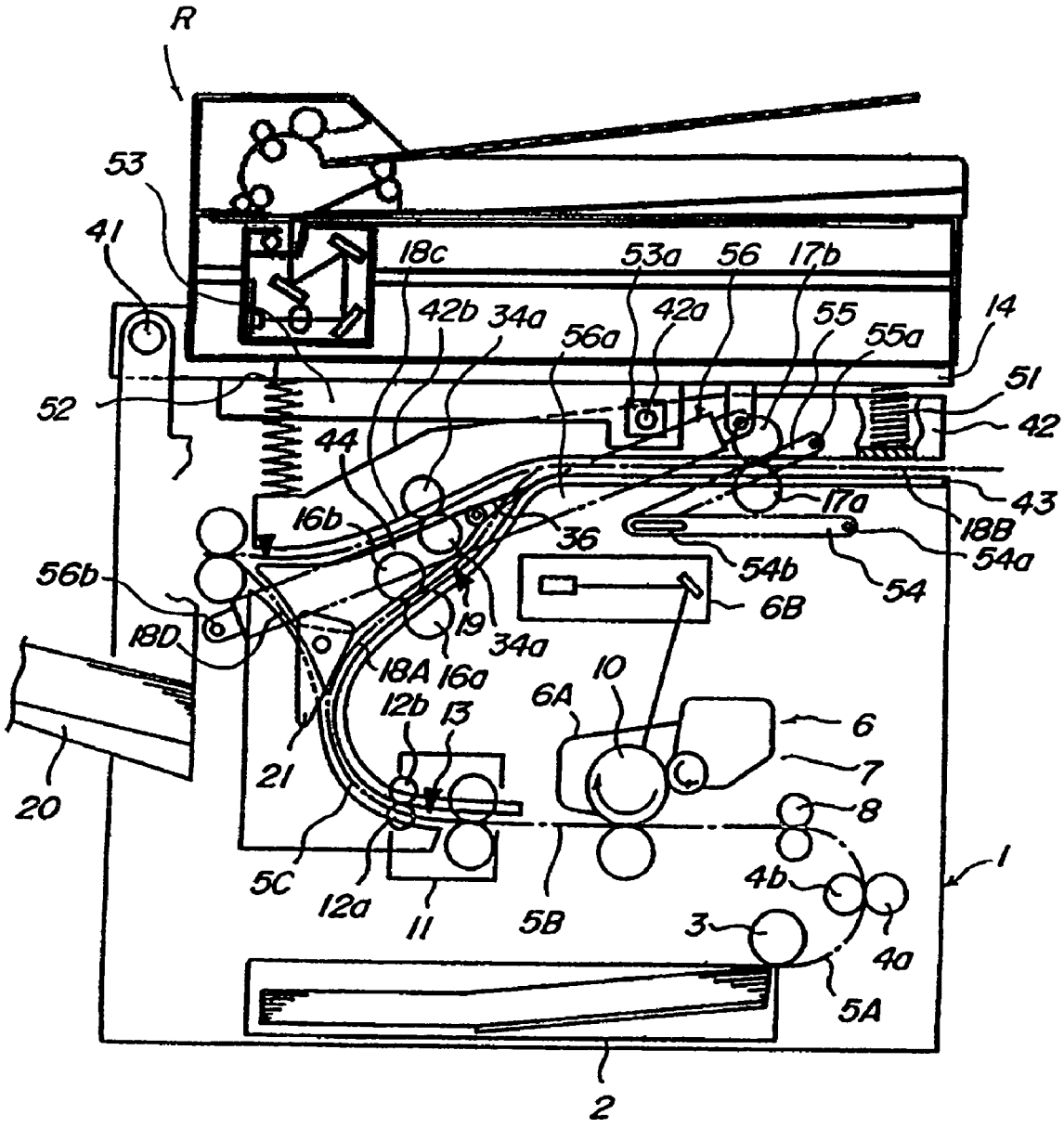
FIG. 3 is a cross-sectional view of a condition where an image forming apparatus equipped with a sheet conveying apparatus according to a second embodiment can operate.
Figure 4:
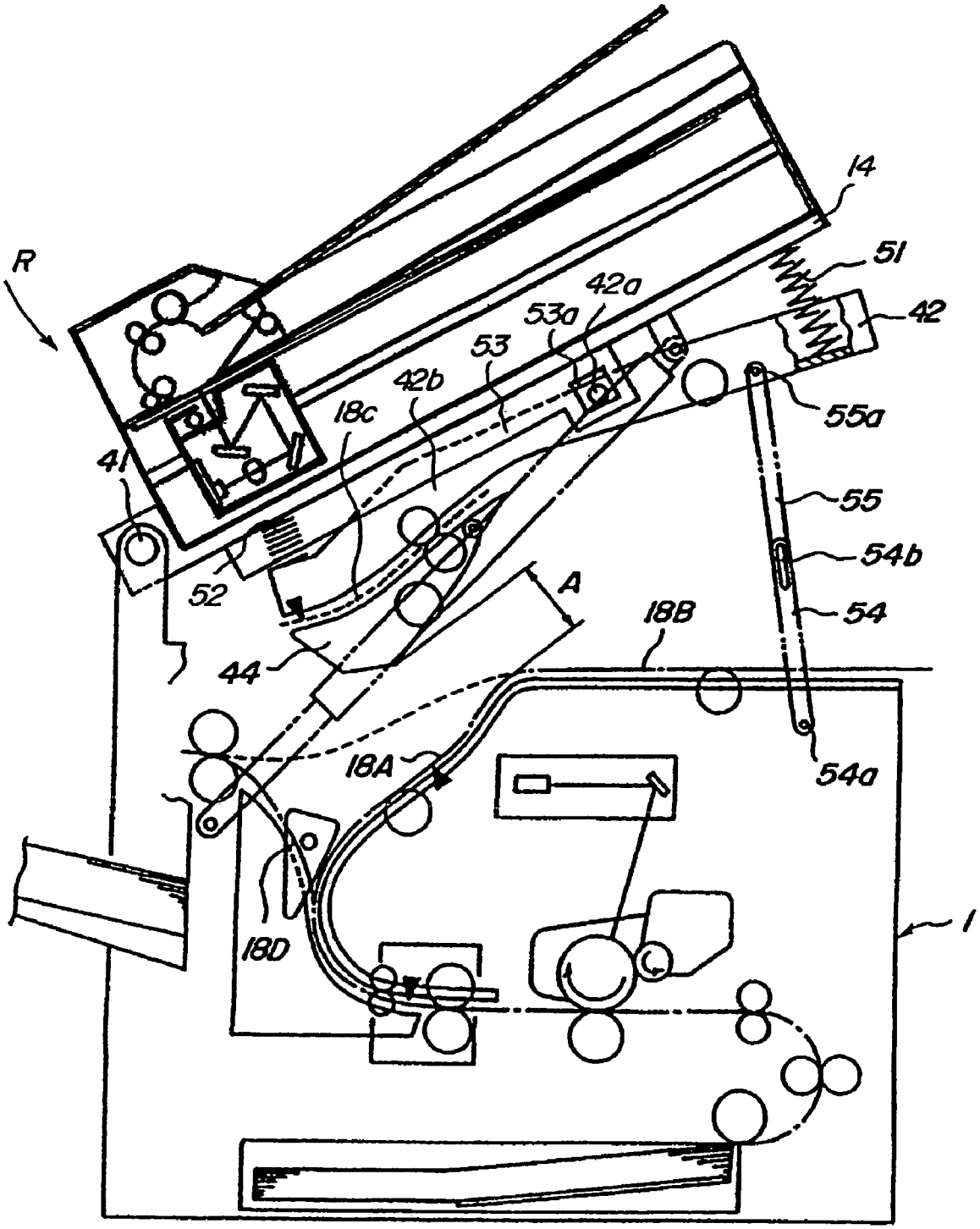
FIG. 4 is a cross-sectional view of a condition where a conveyance path of the image forming apparatus equipped with the sheet conveying apparatus according to the second embodiment is broken up so that a jammed sheet can be cleared.

The following will describe an image forming apparatus equipped with a sheet conveying apparatus according to the second embodiment with reference to FIGS. 3 and 4. FIGS. 3 and 4 are simplified configuration diagrams of the image forming apparatus related to the second embodiment of the present invention. It is to be noted that the simplified configuration of this image forming apparatus is the same as that of the above-described embodiment and so its members having the equivalent functions are indicated by the same symbols and their explanation is not described.

The sheet conveying apparatus in the image forming apparatus according to the present embodiment uses a folding type link member. It is detailed below.

FIG. 3 shows a condition where a printer main body 1 is mounted with a cover body 14 and operable.

The cover body 14 as a movable body that can swing with respect to the printer main body 1 is attached thereto in such a manner that it can swing around a hinge 41.

A first guide 42 serving as a first conveyance guide that forms an upper portion of a sheet conveyance path constituted of a turn-back staying path 18B and a turn-back discharge path 18C has a turn-back roller 17*b* and a conveyance roller 34*b*.

The first guide 42 further has a first spring 51 and a second spring 52. The first spring 51 serving as force application means is provided between the cover body 14 and the first guide 42, to apply a force so that the cover body 14 and the first guide 42 may be separated from each other. The second spring 52 serving as second force application means is provided between the cover body 14 and the first guide 42 on the side of the hinge 41 serving as a swing fulcrum with respect to a support shaft 42*a*, to apply a force so that the cover body 14 and the first guide 42 may be separated from each other.

A second guide 43 serving as a second conveyance guide that forms a lower portion of a sheet conveyance path constituted of a turn-back conveyance path 18A and the turn-back staying path 18B has a turn-back roller 17*a* and a convergence roller 16*a* and is fixed to the printer main body 1.

A third guide, 44 serving as a third conveyance guide that forms an upper portion of the turn-back conveyance path 18A, a lower portion of the turn-back discharge path 18C, and an upper portion of a face-up conveyance path 18D has a convergence roller 16*b*, a conveyance roller 34*a*, and a second flapper 36 and is engaged rotatably with the first guide 42 by an arm (not shown).

The first guide 42 is supported by the cover body 14 movably by inserting the support shaft 42*a* provided on the first guide 42 into a hole 53*a* in a support member 53 provided on the cover body 14. When the cover body 14 is opened as shown in FIG. 4, the first guide 42 and the third guide 44 move together with the cover body 14, thereby breaking up (opening) the turn-back conveyance path 18A, the turn-back staying path 18B, and the face-up discharge path 18D.

Folding type link members 54 and 55 are provided between the cover body 14 and the first guide 42. One end of the first link member 55 is attached in such a manner that it may swing around a swing fulcrum 54*a* provided on the printer main body 1.

One end of the second link member 54 is attached in such a manner that it may swing around a swing fulcrum 55*a* provided on the cover body 14.

The other end 54*b* of the first link member 54 is engaged with the other end of the second link member 55 in such a manner that it may swing, so that in a condition where the printer main body 1 is operable as shown in FIG. 3, the first link member 54 and the second link member 55 are contained between the printer main body 1 and the cover body 14 in such a manner that they are folded.

An absorber 56 is provided between the printer main body 1 and the cover body 14. The absorber 56 has a blunderbuss 56*a* and a flexible rod 56*b*. The blunderbuss 56*a* is attached to the cover body 14 in such a manner that it can swing and the flexible rod 56*b* is attached to the printer main body 1 in such a manner that it can swing. When the damper 56 is in such a condition as shown in FIG. 3, the flexible rod 56*b* is contained in the blunderbuss 56*a*.

The following will describe a condition where the cover body 14 is swung with reference to FIG. 4.

The absorber 56 is always applied a force to in such a direction that the flexible rod 56 may stretch, so that when a lock member (not shown) is released, due to a force from the damper 56 the cover body 14 swings around the hinge 41 counterclockwise with respect to the printer main body 1.

When the cover body 14 swings due to the damper 56 from a first position shown in FIG. 3 to a second position shown in FIG. 4, the first guide 42 also moves together owing to the support member 53 provided on the cover body 14.

When the first guide 42 is raised, the first link member 54 swings around the swing fulcrum 54*a* on the printer main body 1 and the second link member 55 swings around the swing fulcrum 55*a* provided on the first guide 42, so that the mutually engaged ends of the first and second link members 54 and 55 move as following a certain track until the first guide 42 stops at a position where the first and second link members 54 and 55 are stretched as shown in FIG. 4.

When the first guide 42 stops, the cover body 14 also stops swinging despite that the cover body 14 is supplied with a force from the damper 56 in such a direction that it may rotate counterclockwise.

The support shaft 42*a* for the first guide 42 is supported in the hole 53*a* in the support member 53 attached to the cover body 14 in such a manner that the first guide 42 can swing around the support shaft 42*a* with respect to the cover body 14, so that the first guide 42 rotates around the support shaft 42*a* clockwise due to a force applied by the first spring 51 and the link members 54 and 55. And the first guide 42 stops in a condition where its corner 42*b* abuts against the cover body 14.

In this case, a force of the damper raising the cover body 14 is set to a value sufficiently stronger than that of a force of the second spring 52 pressing the first guide 42.

By thus swinging the first guide 42 and the third guide 44 attached to the first guide 42, a site of the first guide 42 on the side of the hinge 41 is additionally separated from the second guide 43. Therefore, even if the cover body 14 swings at a small angle with respect to the printer main body 1, it is possible to enlarge the smallest distance A between the group of guides 42 and 44 moving together with the cover body 14 and the second guide 43 remaining in the printer main body 1 in the vicinity of the hinge 41 serving as the swing fulcrum. Therefore easily clearing a sheet left on the turn-back conveyance path 18A.

Third Embodiment

Figure 5:
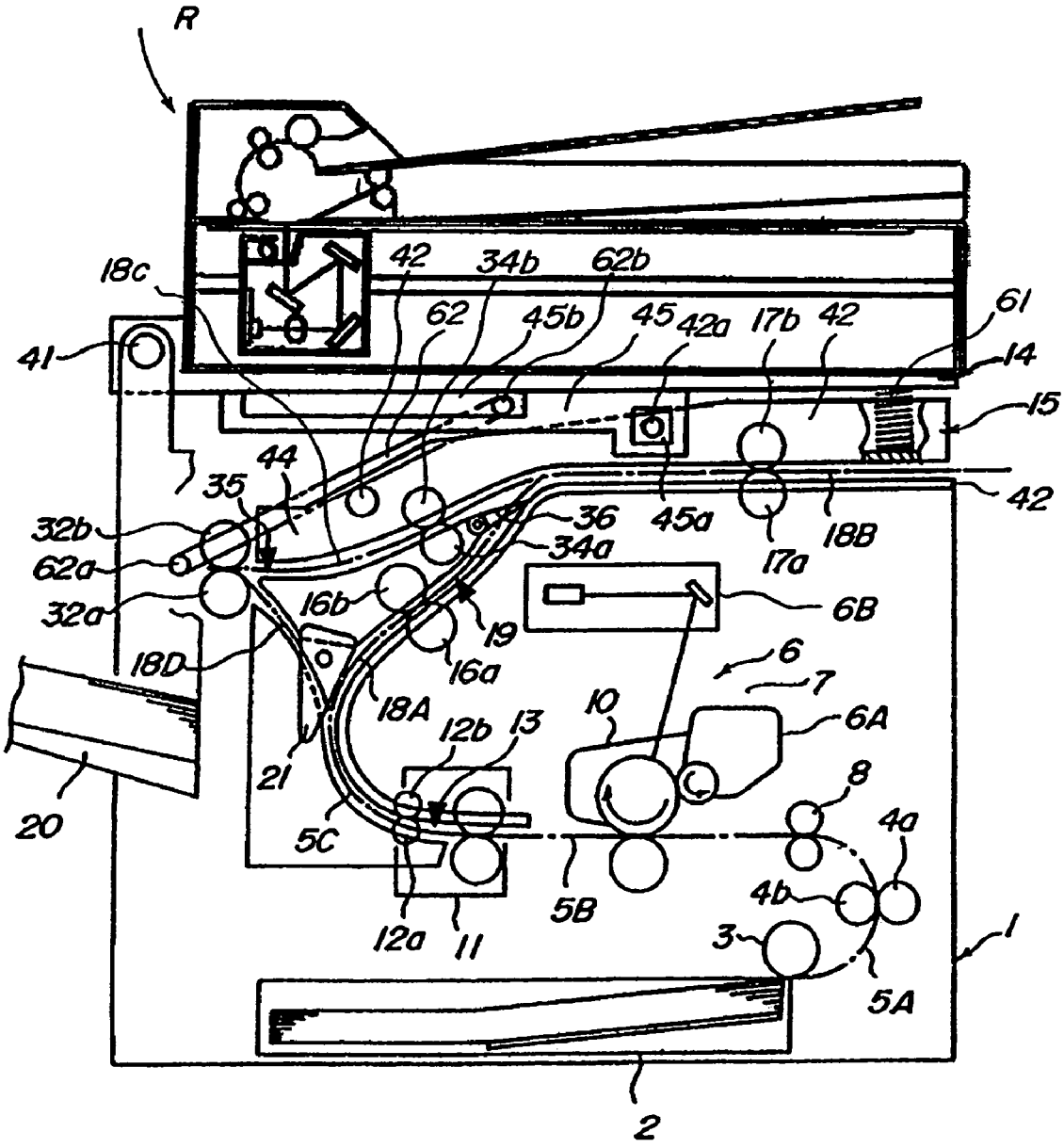
FIG. 5 is a cross-sectional view of a condition where an image forming apparatus equipped with a sheet conveying apparatus according to a third embodiment can operate.
Figure 6:
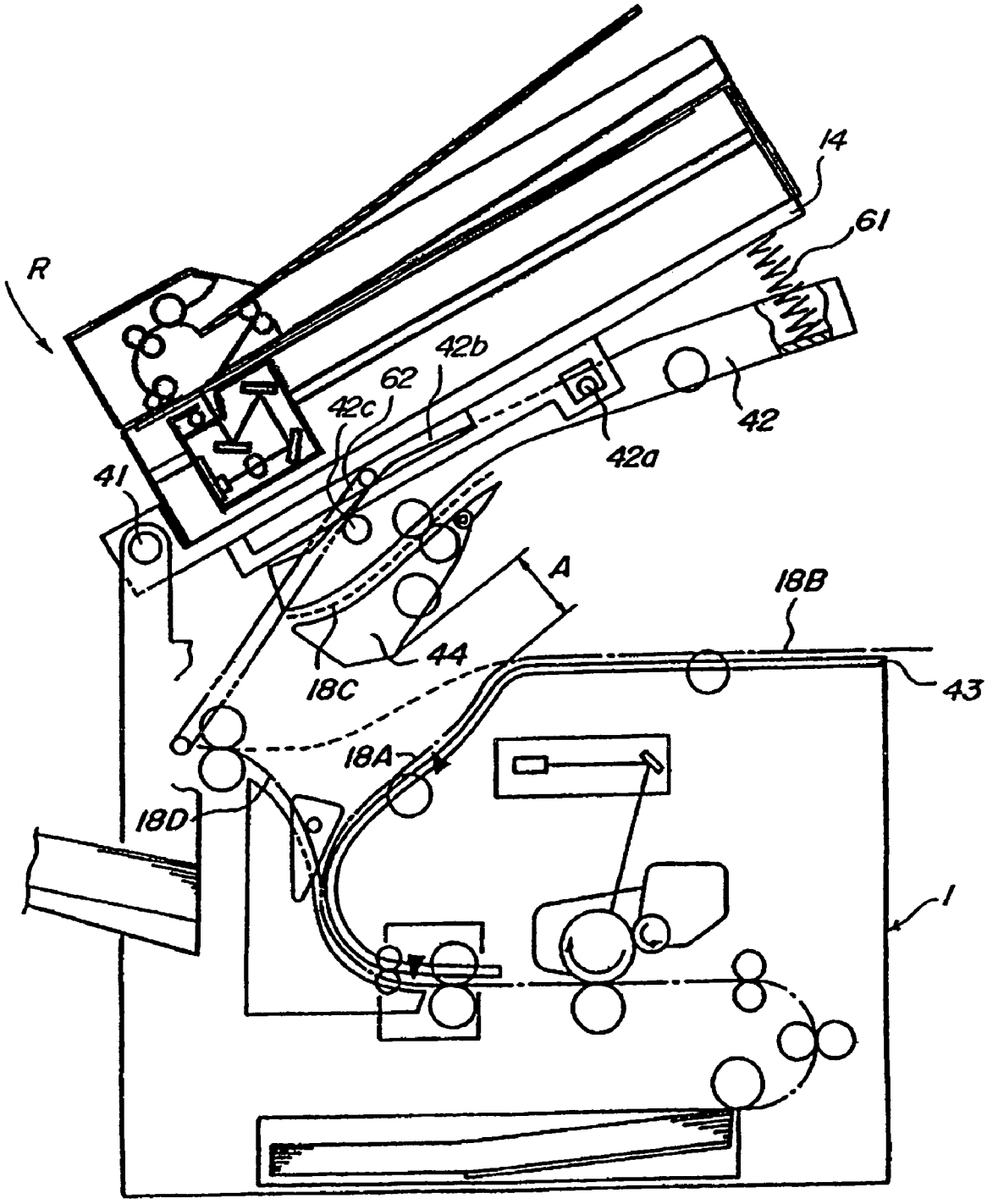
FIG. 6 is a cross-sectional view of a condition where a conveyance path of the image forming apparatus equipped with the sheet conveying apparatus according to the third embodiment is broken up so that a jammed sheet can be cleared.

The following will describe an image forming apparatus equipped with a sheet conveying apparatus according to the third embodiment with reference to FIGS. 5 and 6. FIGS. 5 and 6 are simplified configuration diagrams of the image forming apparatus according to the third embodiment of the present invention. It is to be noted that the simplified configuration of this image forming apparatus is the same as that of the above-described embodiments and so its members having the equivalent functions are indicated by the same symbols and their explanation is not described.

The sheet conveying apparatus in the image forming apparatus according to the third embodiment is a link pressure application member also having a function which a guide link member applies a force to a first guide in a direction of a second guide. It is detailed as follows.

FIG. 5 shows a condition where a printer main body 1 is mounted with a cover body 14 and operable.

The cover body 14 as a movable body that can swing with respect to the printer main body 1 is attached thereto in such a manner that it can swing around a hinge 41.

A first guide 42 serving as a first conveyance guide that forms an upper portion of a sheet conveyance path constituted of a turn-back staying path 18B and a turn-back discharge path 18C has a turn-back roller 17*b* and a conveyance roller 34*b*.

The first guide 42 further has a first spring 61 as force application means. The first guide 61 as the force application means is provided between the cover body 14 and the first guide 42, to apply a force so that the cover body 14 and the first guide 42 may be separated from each other.

A second guide 43 serving as a second conveyance guide that forms a lower portion of a sheet conveyance path constituted of a turn-back conveyance path 18A and the turn-back staying path 18B has a turn-back roller 17*a* and a convergence roller 16*a* and is fixed to the printer main body 1.

A third guide 44 serving as a third conveyance guide that forms an upper portion of the turn-back conveyance path 18A, a lower portion of a turn-back discharge path 18C, and an upper portion of a face-up conveyance path 18D has a convergence roller 16*b*, a conveyance roller 34*a*, and a second flapper 36 and is engaged with the first guide 42 by an arm (not shown).

The first guide 42 is supported by the cover body 14 movably by inserting a support shaft 42*a* provided on the first guide 42 into a hole 45*a* in a guide member 45 provided on the cover body 14. When the cover body 14 is opened as shown in FIG. 6, the first guide 42 and the third guide 44 move together with the cover body 14, thereby breaking up (opening) the turn-back conveyance path 18A, the turn-back staying path 18B, and the face-up discharge path 18D.

A link pressure application member 62 as a link guide member is provided between the printer main body 1 and the cover body 14. The link pressure application member 62 is an elastic member that has a force application action such as a leaf spring or a wire spring like piano wire. One end 62*a* of the link pressure application member 62 is attached in such a manner that it can swing around a swing fulcrum provided on the printer main body 1, while the other end 62*b* is engaged in such a manner that it can move along a guide hole 45*b* formed in the guide member 45.

In a condition where the printer main body 1 is operable as shown in FIG. 5, the cover body 14 presses the first spring 61 to apply a force to the first guide 42 in the direction of the second guide 43. The link pressure application member 62 comes in contact with a protrusion 42*c* formed on a side of the first guide 42 and so flexes, thereby pressing the first guide 42. Accordingly, the first guide 42, the second guide 43, and the third guide 44 abut against each other at their abutments (not shown) to form the turn-back conveyance path 18A, the turn-back staying path 18B, and the turn-back discharge path 18C that compose the sheet conveyance path, thereby permitting a sheet of paper to pass therethrough.

Next, a condition where the cover body 14 is swung is described, with reference to FIG. 6.

When a lock member (not shown) is released, the cover body 14 swings around the hinge 41 counterclockwise with respect to the printer main body 1 and held by a support member such as a damper (not shown) in a condition where it is swung.

When the cover body 14 swings from a first position shown in FIG. 5 to a second position shown in FIG. 6, the link pressure application member 62 also swings around the one end 62*a* supported by the printer main body 1.

Since the other end 62*b* of the link pressure application member 62 moves along the guide hole 45*b* in the guide member 45, the link pressure application member 62 leaves the protrusion 42*c* formed on the first guide 42, to stop applying a pressure to the protrusion 42C formed on the first guide 42. That is, flexure of the link pressure application member 62 with respect to the protrusion 42C is eliminated, thus releasing force application by the first guide 42 in a direction of the second guide 43.

Further, since the first spring 46 applies a force between the cover body 14 and the first guide 42, the first guide 42 turns around the support shaft 42*a* until a corner 42*b* of the first guide 42 comes in contact with the cover body 14.

By thus swinging the first guide 42 and the third guide 44 attached to the first guide 42 with respect to the cover body 14, a site of the first guide 42 on the side of the hinge 41 is additionally separated from the second guide 43; therefore, even if the cover body 14 swings at a small angle with respect to the printer main body 1, it is possible to enlarge the smallest distance A between the group of guides 42 and 44 moving together with the cover body 14 and the guide 43 remaining in the printer main body 1 in the vicinity of the hinge 41 serving as the swing fulcrum, thereby easily clearing a sheet left on the turn-back conveyance path 18A.

OTHER EMBODIMENTS

Although in the above embodiments a printer has been employed as an example of an image forming apparatus, the present invention is not limited to it; for example, any other image forming apparatus such as a copying machine, a facsimile, or a complex machine combining these functionalities may be used so that by applying the present invention to a sheet conveying apparatus used in such an image forming apparatus, the same effects can be obtained.

Further, although a electrophotographic type has been employed as an example of a recording system in the above embodiments, the present invention is not limited to it; for example, any other recording system such as an ink-jet system, for example, may be employed.

What is claimed is:

1. An image forming apparatus comprising:
   - a movable body that can swing around a swing fulcrum with respect to a main body of the apparatus;
   - a first conveyance guide which is movably supported to the movable body and which guides a sheet;
   - a second conveyance guide which is provided on the main body of the apparatus, which guides the sheet,
   - an image formation unit which is provided on the main body of the apparatus and forms an image on the sheet guided by the first conveyance guide and the second conveyance guide; and
   - an image reading unit provided on the movable body, to read an image of an original,
   - wherein the movable body can swing between a first position where the first conveyance guide and the second conveyance guide are combined to form a sheet conveyance path to convey the sheet and a second position where the first conveyance guide is distanced from the second conveyance guide to enlarge a space for the sheet conveyance path; and
   - wherein with rotation of the movable body from the first position to the second position, a part of the first conveyance guide on the swing fulcrum side of the movable body moves in a direction to leave the second conveyance guide and moves toward the movable body.

2. An image forming apparatus according to claim 1, further comprising a force application means provided between the movable body and the first conveyance guide,
   - wherein when the movable body is located at the first position, the force application means applies a force to the first conveyance guide in a direction of the second conveyance guide, and when the movable body swings from the first position to the second position, the force application means applies a force to the first conveyance guide so that the part of the first conveyance guide on the side of the swing fulcrum of the movable body may be separated from the second conveyance guide.

3. An image forming apparatus according to claim 2, further comprising a link guide member provided between the apparatus main body and the movable body, wherein:
   - when the movable body is located at the first position, the link guide member abuts against a part of the first conveyance guide to apply a force to the first conveyance guide in a direction of the second conveyance guide with the force application means; and
   - when the movable body swings from the first position to the second position, the link guide member releases force application to the first conveyance guide in the direction of the second conveyance guide.

4. An image forming apparatus according to claim 3, wherein a part of the first conveyance guide is a pressure application member which can move in a direction in which the first conveyance guide moves with respect to the movable body; and when the movable body is located at the first position the link guide member abuts against the pressure application member so that a pressure applied by the pressure application means may apply a force to the first conveyance guide in a direction of the second conveyance guide, and when the movable body swings from the first position to the second position the link guide member releases force application by the pressure application member on the first conveyance guide in the direction of the second conveyance guide.

5. An image forming apparatus according to claim 3, wherein the link guide member is a link pressure application member which has a force application action;

a part of the first conveyance guide is a protrusion formed on the first conveyance guide; and when the movable body is located at the first position the link guide member abuts against the protrusion and so flexes to thereby apply a force to the first conveyance guide in a direction of the second conveyance guide, and when the movable body swings from the first position to the second position, a flexure of the link guide member with respect to the protrusion is eliminated, thereby releasing force application to the first conveyance guide in the direction of the second conveyance guide.

6. An image forming apparatus according to claim 1, further comprising a link member provided between the apparatus main body and the first conveyance guide, wherein when the movable body swings from the first position to the second position, the link member moves the first conveyance guide with respect to the movable body in such a manner that the part of the first conveyance guide on the side of the swing fulcrum of the movable body may be separated from the second conveyance guide.

7. An image forming apparatus according to claim 1, wherein the first conveyance guide is provided so as to be supported to the movable body in such a manner that the first conveyance guide can swing around a support shaft and stretch from the side of a swing fulcrum of the movable body toward the side of a swing end;

the sheet conveying apparatus further comprises a spring that applies a force to a site of the first conveyance guide on the side of the swing end with respect to the support shaft toward the side of the second conveyance guide; and when the movable body swings from the first position to the second position, a force applied by the spring causes the first conveyance guide to swing so that a site of the first conveyance guide on the side of the swing fulcrum may move with respect to the movable body in such a direction as to separate from the second conveyance guide.

8. An image forming apparatus according to claim 1, wherein the image reading unit has a glass on which an original to be read is stacked, a light source for emitting light with which the original stacked on the glass is irradiated, and a photoelectric transducer which performs photoelectric conversion transferring the light reflected of the original.

* * * * *